United States Patent [19]

Wang

[11] Patent Number: 4,756,032

[45] Date of Patent: Jul. 12, 1988

[54] INFLATABLE POOL

[76] Inventor: Cheng-Chung Wang, 7 Fl., No. 37, An Ho Road, Taipei, Taiwan

[21] Appl. No.: 913,113

[22] Filed: Sep. 29, 1986

Related U.S. Application Data

[63] Continuation-in-part of Ser. No. 467,546, Feb. 17, 1983, Pat. No. 4,547,919.

[51] Int. Cl.[4] ..... E04H 3/18; A47K 3/06

[52] U.S. Cl. ..... 4/506; 4/588; 52/2; 383/3

[58] Field of Search ..... 5/441, 449, 452, 457, 5/458; 297/DIG. 3; 4/506, 488, 588; 52/2; 383/3; 150/55

[56] References Cited

U.S. PATENT DOCUMENTS

| | | | |
|---|---|---|---|
| 3,030,640 | 4/1962 | Gosman | 5/455 |
| 3,631,544 | 1/1972 | Tytel | 4/506 |
| 3,780,388 | 12/1973 | Thomas et al. | 5/457 |
| 4,045,833 | 9/1977 | Mesek et al. | 5/484 |
| 4,360,396 | 11/1982 | Marbach | 5/457 |

FOREIGN PATENT DOCUMENTS

| | | | |
|---|---|---|---|
| 1408023 | 6/1965 | France | 4/506 |
| 331459 | 7/1958 | Switzerland | 5/457 |

*Primary Examiner*—Alexander Grosz
*Attorney, Agent, or Firm*—McGlew and Tuttle

[57] ABSTRACT

An inflatable pool comprises a base sheet and a hollow inflatable wall having its bottom end heat sealed to the edge of the base sheet. The wall includes a pair of first sheets sealed together at first seal seams forming a plurality of compartments, and a pair of second sheets sealed to the compartments at second seal means and also the top edges of the second sheets are sealed together forming the envelope of the wall. The construction of the wall of the inflatable pool is stronger and stiffer and the outer surfaces of the wall are flatter and smoother than that of conventional inflatable pools.

2 Claims, 3 Drawing Sheets

INFLATABLE POOL

CROSS-REFERENCE TO RELATED APPLICATION

This is a continuation-in-part of application Ser No. 467,546 filed Feb. 17, 1983, now U.S. Pat. No. 4,547,919.

BACKGROUND OF THE INVENTION

This invention relates to an inflatable pool and particularly to an inflatable pool having an inflatable wall with axially extending and intercommunicated elongated air compartments. The compartments are formed by axial heat seal seams at the outer side of the wall and on the interior of the wall. Each of the heat seal seams on the outer side is staggered with respect to the interior seams It is known in the art to provide a portable and collapsible inflatable pool for use as a bath tub or a swimming pool for children. A typical inflatable pool which was available heretofore, includes a tubualr inflatable wall with a single tubular air compartment which is usually fabricated in a smaller size and height because of the weakness of its construction. There is also provided another form of inflatable pool which has a tubular inflatable wall with two or more intercommunicated tubular air compartments structurally interconnected along ring-shaped heat seal seams. Such a construction permits the fabrication of a larger pool, but, when a large quanity of water is held in the pool, the wall thereof becomes deformed. Therefore, it is still necessary to provide a stronger and stiffer wall for a large inflatable pool which is capable of bearing greater fluid pressure.

A strong construction for inflatable articles, such as seat cushions, mattresses, life rats, lift jackets, sleeping bags and the like was proposed in U.S. Pat. No. 3,030,640. These articles are composed of permanently inflated non-communicating compartments whose individual puncturing and deflation will not result in the deflation of the other compartments. Since the permanently inflated non-communicating compartments cannot allow the article to be deflated and collapsed into a compact and portable size, such a construction is not suitable for the fabrication of a pool which is large and therefore must necessarily be deflated when it is stored.

U.S. Pat. No. 3,547,919 disclosed the construction of multi-compartmented inflatable articles in which heat seal seams are reformed and reinforced. The invention of the present application uses a similar construction in fabricating an inflatable pool.

U.S. patent application Ser. No. 738,067 filed on May 24, 1985 now U.S. Pat. No. 4,651,360, by the same inventor as the present invention, discloses an inflatable pool which comprises a base sheet and a hollow-shaped inflatable wall having its bottom end heat-sealed to the edge of the base sheet. The wall is provided with outer heat seal seams and inner heat seal seams which extend axially and divide the wall into a plurality of elongated air compartments that intercommunicate and structurally interconnect. The outer heat seal seams are staggered with respect to the inner heat seal seams and the outer portion of the wall is a continuous seal free portion.

Other pertinent prior art relating to an inflatable pool are U.S. Pat. Nos. 3,361,544; 3,780,388 and 4,360,396, and French Pat. No. 1,408,023. It is noted that none of the above noted prior art ever disclosed a pool structure having a smooth and flat outer surface on the wall portion. Besides, the pool structure disclosed in the prior art does not have a strong construction.

SUMMARY OF THE INVENTION

It is therefore an object of the present invention to provide an inflatable pool with stronger and stiffer construction.

Another important object of the present invention is to provide an inflatable pool having a smooth and flat outer surface on its wall for permitting the application of drawings thereon.

The first feature of the present invention is to provide the wall of the inflatable pool, with more than four plies of sheet material sealed together and forming a stronger construction.

Another feature of the present invention is to make the seal seams on the outermost sheet forming the wall of the inflatable pool, non-continuously. This can be preferably a series of seals causing the outer surface of the wall to be relatively smooth and flat.

This and other objects can be achieved in accordance with the present invention through the provision of an inflatable pool which is comprised of a base sheet having an edge bounding the sheet, and a hollow inflatable wall made of a gas impervious, heat sealable material and having its bottom end heat sealed to the edge of the base sheet. This wall includes a pair of first sheets sealed together at first seal seams forming a plurality of elongated compartments, and a pair of second sheets sealed to the compartments at second seal seams. The edges of the second sheets are sealed together to form the air envelope of the wall. The second seal seams may be non-continuous, such as a series of dot seals causing the outer surface of the wall to be smooth and flat.

The present exemplary preferred embodiment will be described in detail with reference to the accompanying drawings.

Figure 4A:
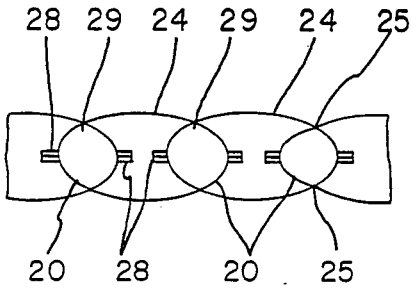
Figure 5:
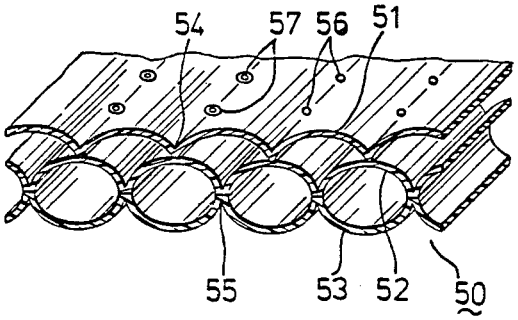
Figure 6:
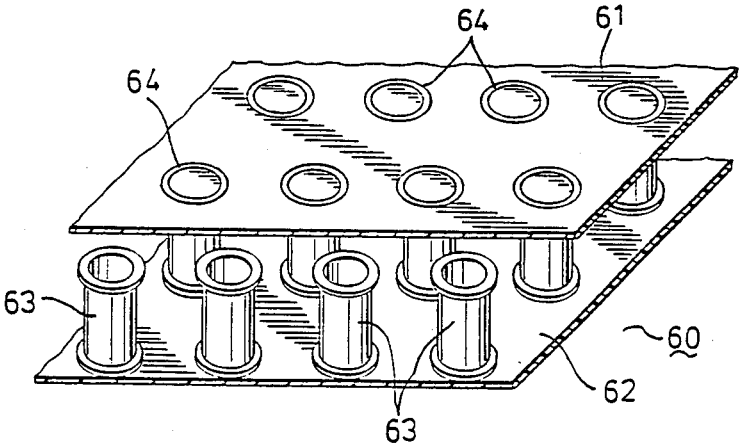

FIG. **4*a*** is a sectional view of the wall in a third embodiment of the inflatable pool according to the present invention with the inner compartments inflated;

FIG. **4*b* is a view similar to FIG. 4*a*** but with the inner compartments un-inflated;

FIG. 5 is a partly sectioned perspective view of the wall in a fourth embodiment of the inflatable pool according to the present invention; and FIG. 6 is a partly sectioned view of the wall in a fifth embodiment of the inflatable pool according to the present invention.

DESCRIPTION OF THE PREFERRED EMBODIMENTS

Figure 1:
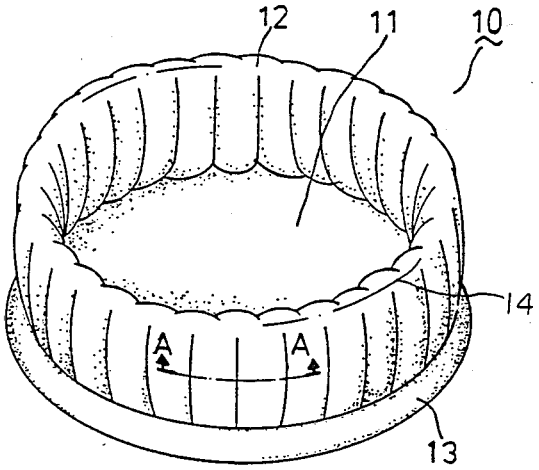
FIG. 1 is a perspective view of an inflatable pool embodying the present invention.
Figure 2:
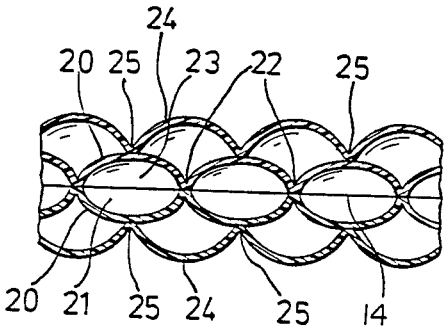
FIG. 2 is a sectional view taken along the line A—A of FIG. 1 showing the structure of the wall of the inflatable pool.

Referring to FIG. 1 and with reference to FIG. 2, the inflatable pool 10 of the present invention includes a base sheet 11 with a circular edge and an inflatable hollow cylindrical wall 12 which are made of a gas impervious, heat-sealable plastic material, such as PVC sheet. The wall 12 may also be a hollow oval shape or the like. There is further provided a reinforcing ring-shaped inflatable member 13 at the bottom end of the wall 12.

Referring to FIG. 2, the wall 12 is comprised of a pair of first sheets 20 sealed respectively at seal seams 22 forming a plurality of inner compartments 21, 23, etc. A pair of second sheets 24 are sealed to said compartments 21, 23 at seal seams 25 to form an envelope of the wall. The top edges of the second sheets 24 are sealed together at seal seam 14 to close the envelope of the wall. Of course, the top edges of the first sheets 20 can also be sealed together with the top edges of the second sheets 24 at 14 but with the sheet material for forming each compartment having an opening thereon, for the purpose of inflating the wall 12 of the inflatable pool 10. The construction of the wall 12, stated hereinabove, is particularly necessary for an inflatable pool having a large diameter. It is easily understood that this construction of the wall 12 makes the pool stronger and stiffer.

Figure 3:
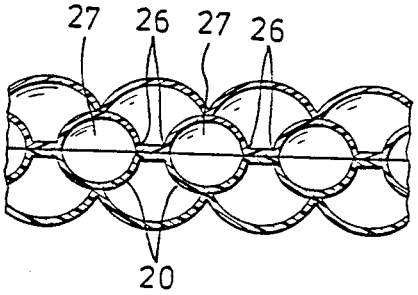
FIG. 3 is a sectional view of the wall in a second embodiment of the inflatable pool according to the present invention.

Referring to FIG. 3 which shows another embodiment of a wall structure of the inflatable pool, the structure of the wall is almost the same as that shown in FIG. 2 except the compartments 27, formed by the first sheets 20, are not connected directly to each other because the seal seams 26 on the first sheets 20 form pairs of separate seal seams 26. It can be seen that when the envelope of the wall is inflated, the seal seam 26 will confine the compartments 27 so that they do not deform as much as that shown in FIG. 2. This will cause the wall of the inflatable pool to be stronger in its structure.

Figure 4B:
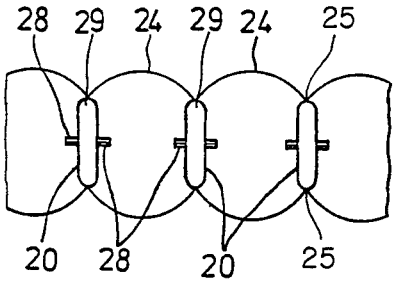

Referring to FIGS. 4*a* and 4*b* which show another embodiment of the wall of the inflatable pool, the first sheets 20 are sealed at seal seams 28 and cut separately, forming isolated compartments 29. If the compartments 29 are each inflated, the shape of the wall will be like that shown in FIG. 4*a*. On the other hand, if the first sheets 20 are not sealed with respect to the space between the sheets 24, to form closed compartments, the shape of the wall shall be like that shown in FIG. 4*b*. In this situation, by comparing the structure of the wall in the preceding embodiments, it can be seen that the outer surface of the wall becomes flatter and smoother than the wall in the above embodiments. Therefore, one can easily paint drawings on the outer surface of the wall which will not be deformed much when the inflatable pool is inflated.

Another embodiment of the wall of the inflatable pool is shown in FIG. 5. The wall 50 comprises three plies of sheets 51, 52, and 53, sealed to each other at seals 54 and 55. In this particular embodiment, the seal seams 54 and 55 are non-continuous seal seams which are preferably a series of dot seals 56 or circular seals 57. This can be achieved by adopting a proper mold having corresponding protrusions to apply on the sheets to be heat sealed. Those seals 56 or 57 are preferably offset with the seals on seal seam 55 to provide a better structure. It is also to be noted that four plies or more of the sheets can be used to form a stronger structure of the wall in the inflatable pool. In this situation, only the seal seams on the outermost sheet may necessary be non-continuous ones. This is another way to make the outer surface of the wall flatter and smoother than the wall structure in a conventional inflatable pool.

Referring to FIG. 6, which shows another embodiment of the wall in an inflatable pool, the wall 60 comprises a top sheet 61 and a bottom sheet 62 seal-connected by a plurality of sealing members 63. The sealing members 63 are generally in a cylindrical shape with the seal seams 64 on the sheets 61 and 62 being in a circular shape. It is seen that by this structure the outer surface formed by the sheets 61 or 62 is much flatter and smoother than the outer surface in the preceding structure of the walls.

It can be appreciated that the pool constructed according to the present invention has the advantages of being stronger and stiffer in the construction thereof and a flatter and smoother outer surface of the wall thereof is obtained for drawings and for decorative purposes.

With the invention thus explained, it is apparent that various modifications and variations can be made without departing from the scope of the invention. It is therefore intended that the invention be limited as indicated in the appended claims.

What is claimed is:

1. An inflatable pool comprising: a base member (11) made of gas impervious, heat sealable material having an edge bounding said base member; a hollow inflatable wall (12) made of a gas impervious, heat sealable material having its bottom end connected to said edge of said base member (11), said wall including a pair of first sheets (20) sealed at respective first seal seams (28) forming a plurality of compartments and a pair of second sheets (24) covering said compartments and sealed to each of said compartments at second seal seams (25), at least said second sheets (24) being also sealed together at their top edges (14) forming an envelope of the wall (12) and wherein said first seal seams (28) include pairs of seal seams causing said compartments (29) to be each separate from each other thereby forming a stronger and stiffer structure of the wall (12), said first sheets (20) being also sealed at their top edges (14) for forming independent air tight compartments (29) in the wall (12).

2. An inflatable pool as claimed in claim 1 wherein said first sheets (20) defined between each pairs of seal seams (28) are cut apart causing said compartments (29) to be isolated from each other.

* * * * *